US005471975A

United States Patent [19]

Wilke

[11] Patent Number: 5,471,975

[45] Date of Patent: Dec. 5, 1995

[54] GAS POWER PLANT

[75] Inventor: Rudeger Wilke, Darien, Ill.

[73] Assignee: Savage Bros. Co., Elk Grove Village, Ill.

[21] Appl. No.: 352,607

[22] Filed: Dec. 9, 1994

[51] Int. Cl.[6] ..... A47J 27/00

[52] U.S. Cl. ..... 126/373; 126/376; 126/343.5 A; 126/92 AC

[58] Field of Search ..... 126/373, 374, 126/343.5 R, 343.5 A, 92 R, 92 AC, 50, 376, 377, 380, 375

[56] References Cited

U.S. PATENT DOCUMENTS 2,595,527 5/1952 Kells et al. ..... 126/374
3,788,302 1/1974 Malaney ..... 126/374
4,688,549 8/1987 Blankemeyer ..... 126/373
4,889,103 12/1989 Fraioli ..... 126/373

*Primary Examiner*—James C. Yeung
*Attorney, Agent, or Firm*—Paul H. Gallagher

[57] ABSTRACT

A casing having an upper compartment and a lower compartment; it has a top opening for holding a candy kettle, and a refractory burner in the upper compartment under the kettle. A blower and fuel supply means are in the lower compartment. The burner is of large capacity for fast cooking, and the burner includes construction and controls of compact arrangement to accommodate large capacity and small space.

13 Claims, 3 Drawing Sheets

GAS POWER PLANT

CROSS REFERENCE

Copending Application by the same inventor, titled Gas Power Plant, U.S. Pat. No. 08/352,570 filed Dec. 9, 1994.

SUMMARY OF THE INVENTION

The invention resides in the general field of gas power plants. The present device, as an example of a specific embodiment of the broad invention, is adapted to cooking candy, as will be referred to in detail hereinbelow.

A broad object of the invention is to provide a gas power plant of great capacity while being very compact and of small dimensions.

Another main object is to provide such a power plant that is of great capacity and adaptable to a wide variety of circumstances and conditions, including selectively small and large installations, and including the capability of later adding on additional components on an original basic unit.

Another great feature is its efficiency, including, the use of infra red heat in addition to convection heat, and its capability of concentrating great quantities of heat in a small area or space when desired.

Another object is to provide such a gas power plant that is capable of producing great quantities of heat in an arrangement to facilitate transmission of the heated medium to great distances, and also including the feature of portability to adapt it to any of a great number of different circumstances or conditions.

BRIEF DESCRIPTIONS OF THE INDIVIDUALS FIGURES OF THE DRAWINGS

DETAILED SPECIFICATION

Figure 4:
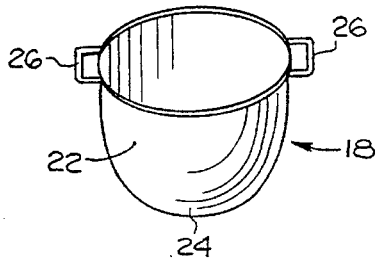
FIG. 4 is perspective view of the candy kettle used in the cooker.
Figure 5:
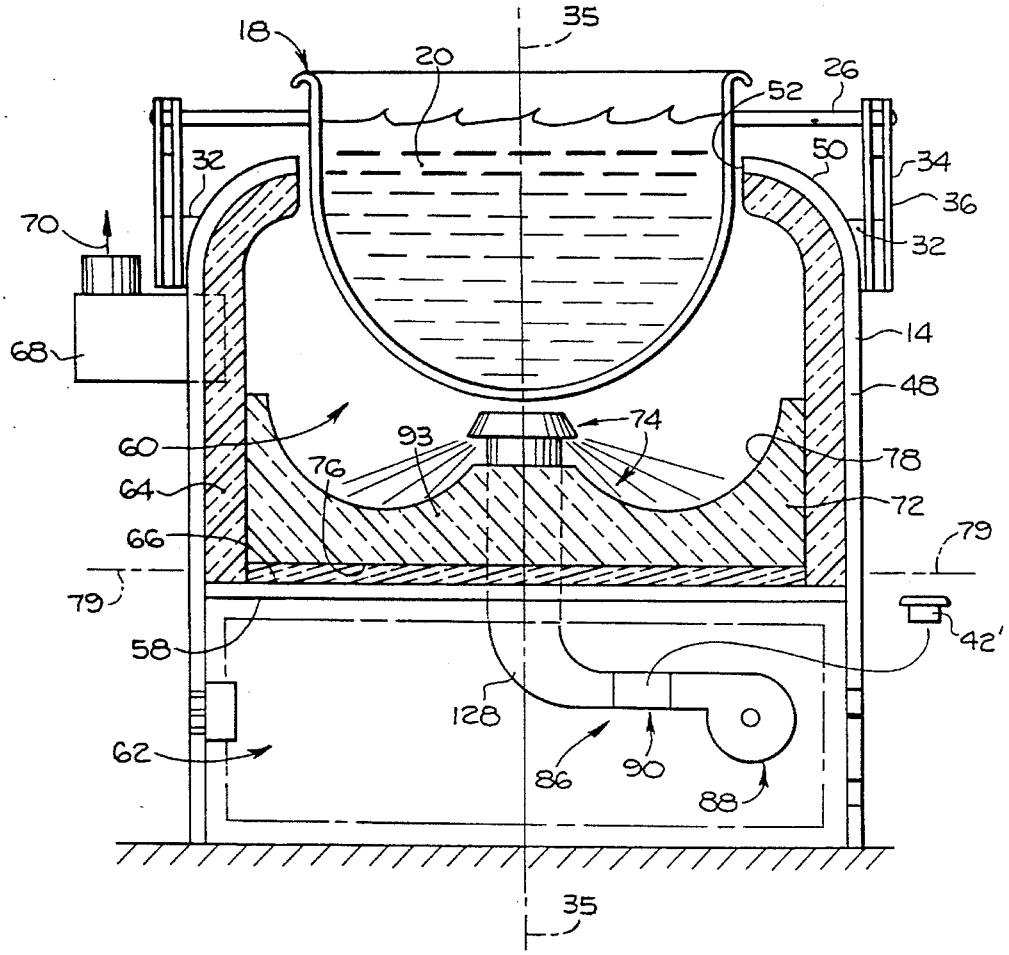
FIG. 5 is a vertical sectional view of the cooker with the kettle therein, and without the stand.

As noted above, the invention is of such broad scope as to be adaptable to and operable in a wide range of capacity and heating conditions. The present disclosure is a candy cooker, representing a relatively smaller installation. The candy cooker is identified as a whole at 12 and includes a casing 14, a stand 16, FIG. 4 showing a kettle 18 for containing a batch of candy 20 (FIG. 5). This kettle is a known item used in candy making, made of copper and being cylindrical at the top at 22, and having a hemispherical bottom 24. The kettle is provided with loop handles 26 at opposite sides, these handles being utilized in mounting it in the stand 16, and for carrying.

The stand 16 which may also be referred to as a frame may be of suitable structure including a base 28 and a column or standard 30 rising therefrom. The stand 16 may be normally stationary, resting on the floor 32, but it may be provided with casters or wheels, if desired. The casing 14 normally rests on the base 28. Included in the stand 16 are a pair of arms 34 which straddle the casing and extend beyond the central vertical axis 35 thereof as will be referred to again. Mounted on the arms are supports 34 each having spaced upright side elements 36 and a cross bar 38 adjacent to but below the top of the side elements. These supports are for supporting the handles 26 of the kettle as will be described again hereinbelow.

The stand or frame 16 is utilized for mounting various other instrumentalities, such as a control box 40 having various control elements 42 for controlling various operating components of the device. One of these elements, identified 42' will be found in FIG. 5 and referred to again hereinbelow.

Figure 1:
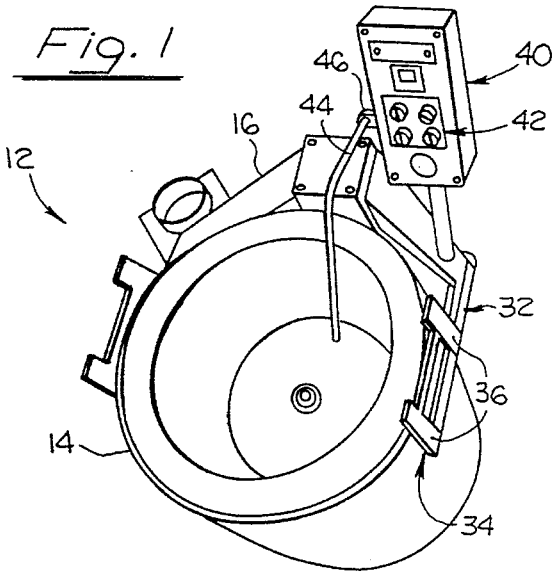
FIG. 1 is perspective view, from above at an angle, of a candy cooker embodying the features of the present invention.
Figure 2:
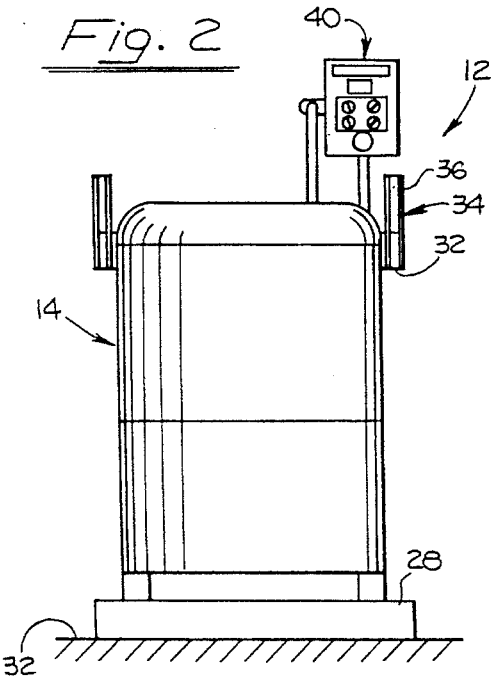
FIG. 2 is an elevational front view.
Figure 3:
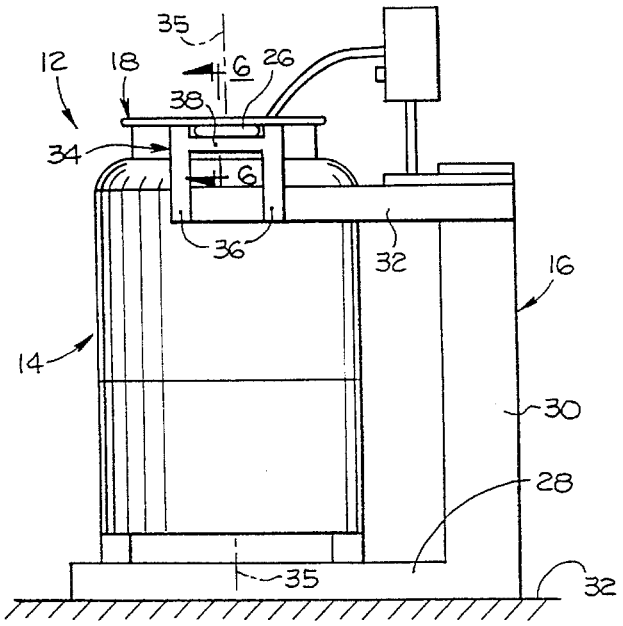
FIG. 3 is an elevational side view from the right of FIG. 1, and including a kettle.

A temperature sensor element 44 (FIG. 1) is swingably mounted at 46 on the control box and operably connected with a temperature indicating element or thermometer in the control box. This sensing element here shown as the shape of a rod is swingable downwardly into a lower position in which its sensing tip extends into the candy batch, and to an upper position clear of the casing to enable the kettle to be inserted in and removed from the casing.

The casing 14 is preferably cylindrical for the most part, and includes a shell or skin 48 having an inturned annular portion 50 at the top defining a circular kettle opening 52. FIG. 5 shows the central vertical axis 35 of the casing.

Figure 6:
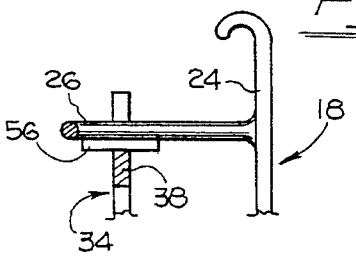
FIG. 6 is a fragmentary sectional view taken at line 6—6 of FIG. 5.

FIG. 5 shows the position of the kettle when mounted in the casing, in relation to the burner and other elements. The kettle is handled and transported by other equipment, to and from the present device and in placing it in the casing, it is inserted in the central hole 52 with the handles 26 engaging and resting on the supports 34. The hole 52 is predimensioned to receive the kettle in a position in which the kettle nearly touches the rim of the hole. It is spaced therefrom only slightly, so that only negligible heat escapes therethrough, which is an important feature of the invention. Shims 56 (FIG. 6) may be utilized, placing them on the cross bars 38 for supporting the kettle at the exact height desired for the proximity relation with the edge of the hole 52 as referred to above. The hole 52 is predimensioned for receiving the cylindrical surface 22 of the kettle.

The casing 14 is provided with a transverse horizontal partition or space divider 58, dividing the casing into an upper compartment or chamber 60 and a lower compartment or chamber 62, and forming a floor of the upper compartment. In the upper compartment a liner of heat insulation 64 lines the side wall of the shell, up to the edge of the hole 52, and a layer 66 is positioned on the floor.

The casing (FIG. 5) is provided with an outlet duct 68 for conducting gases, as indicated by the arrow 70 to controlled areas, in contrast to releasing the heated gases in the ambient surroundings. This facilitates control of the surrounding temperatures, as for example when the area is air conditioned and the escape of heat is undesired, or in an alternate situation, where additional heat is desired in controlled conditions in other areas.

Positioned in the upper compartment 60 is a refractory element 72 constituting a major element of a burner 74. This refractory element has a flat bottom surface 76 and rests on the insulation layer 66 on the supporting floor 58. The refractory element has a concave reflecting or firing surface 78, of half-toroid shape, and positioned on one side of a transverse plane 79 perpendicular to the central axis 35. The burner is positioned coaxial with the casing.

Figure 7:
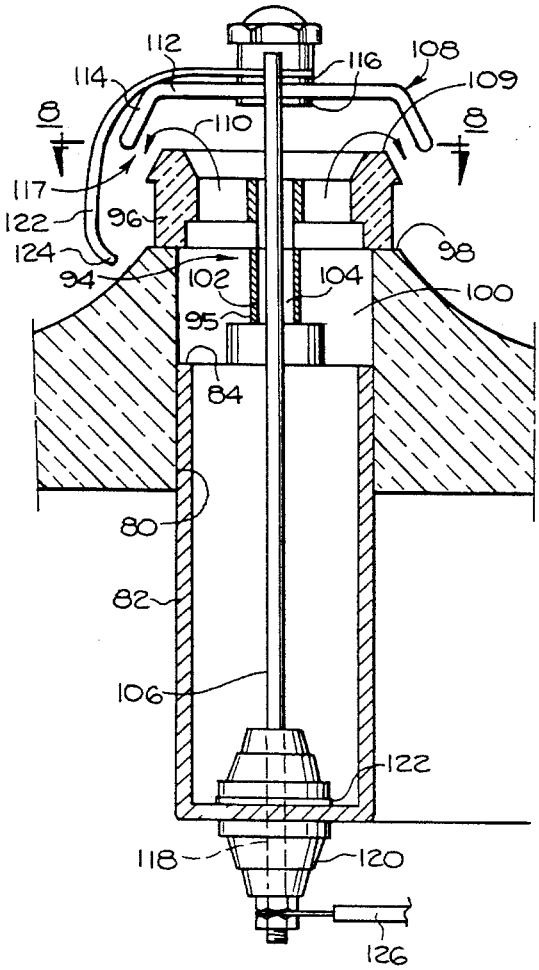
FIG. 7 is an axial sectional view of the central portion of the burner, located at the center of FIG. 5.

Attention is directed to FIG. 7 showing the specific construction of the elements directly related to the refractory element 72. The refractory element has a central axial hole 80 into which leads a fuel mixture pipe 82 terminating at 84 in the hole.

Figure 10:
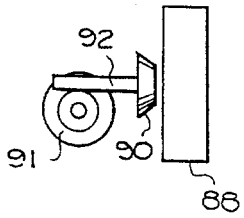
FIG. 10 is a view taken at line 10—10 of FIG. 9.

As indicated above, the burner component itself is mounted in the upper chamber, and the fuel mixing, or fuel supplying, component is mounted in the lower chamber. In FIG. 5, a fuel mixing component is indicated at 86, this illustration being only diagrammatic, the emphasis of the present invention residing in the burner proper, but reference is made to my co-pending application identified above, for a preferred form of fuel mixing and control component. Such fuel mixing component includes a blower 88, with a progressively controlled valve 90 (FIG. 10) which is driven gradually by a servo motor 91 which moves the valve by means of a rack and pinion component 92. The servo motor is controlled by the control button 42', identified above, and mounted in the control box 40. Upon manipulation of the control element 42' the valve 90 is progressively controlled for gradually controlling the flow of fuel mixture to the refractory burner member. The details of this control valve 90 need not be entered into the present instance, except to point out that the fuel mixture is directed onto the reflecting surface 78 in varying amounts. For example it may be desired to have the fuel impinged on that surface only at the radially inner portion, indicated at 93, or progressively radially outwardly therebeyond to produce greater heat, as desired, to be applied to the kettle.

Figure 8:
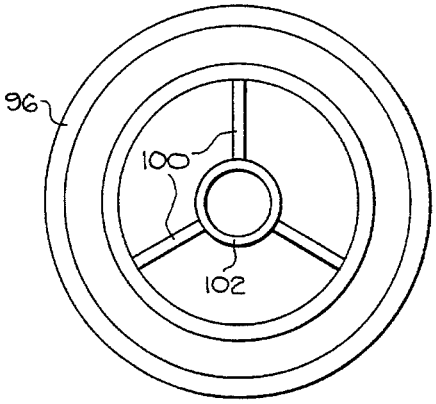
FIG. 8 is a view containing certain elements of FIG. 7, in association with other elements.

Referring again to FIG. 7, this figure shows a flame distributor 94, having a base portion 95 fitted in the hole 80 and an upper annular rim 96 positioned above the hole, and fitted downwardly against the hub 98 of the refractory element. This flame distributor also includes radiating vanes 100 (see also FIG. 8) and an inner sleeve 102. Fitted in the sleeve is an electrically insulating bushing 104, and mounted in the bushing, and thus in the flame distributor, is a support rod 106 on the upper end of which is mounted a flame deflector cap 108. The flame distributor 94 extends above the hub 98 and its upper end is of course open through a top circular edge 109, and the fuel mixture from the pipe 82 emerges therefrom as indicated by the arrows 110. The deflector cap 108 has a top flat portion 112 and a surrounding downturned rim 114. The rim 114 and the top edge 109 form a circumferentially continuous gap or nozzle 117 therebetween.

The rod 106 extends downwardly through the fuel mixture pipe 82, as indicated at 118, and is secured thereto by nuts 120. Electrical insulators 122 are interposed between the rod and the pipe.

The deflector cap 108 is preset in the factory in the manufacture of the device, for correspondingly determining the size of the outlet gap or nozzle 117. This presetting is made according to various factors, such as a certain predetermined range of temperature, and size and capacity of the burner, and other factors. It may be adjusted of course by adjusting it vertically on the support rod 106, or adjusting the rod itself, with the cap, at the mounting 118 and after it has been so adjusted to a satisfactory position according to working conditions, it is normally left in such adjusted position. The nozzle then normally remains in fixed position in use in the customer's operations.

A flame sensor 122 is provided which is an electrically conductive wire secured to the rod 106, at the top, and extends over the deflector cap and has a terminal point 124 extending down below the edge of the rim 114 at the nozzle 117, and extending into the flame when a flame exists. At the bottom of the rod, an electrical conductor 126 (FIGS. 7 and 9) is secured and leads to the control box 40 in which are various control instrumentalities, as referred to above.

Various ones of the elements constitute an electrical circuit, as follows: the sensor 122, the rod 106, the conductor 126, together form one electrode; the flame distributor 96 and fuel pipe 82 are electrically connected and form a second electrode; and leading from the pipe is another conductor 128 leading to an instrumentality in the control box 40. The bushing 104 is of electrical insulation, and forms an insulator between the rod 106 and the flame distributor, and thus between the two electrodes. The sensor 122 in its sensing mode, senses the flame at the outlet of the nozzle, and the flame then constitutes a conductive element in the electrical circuit.

The control box 40 includes various control instrumentalities of known kind. One is utilized for controlling the sensor 122. This control instrumentality, is operable in the present device for first producing a spark for a desired period of time, for example, three and one half seconds, for igniting the fuel mixture emerging from the nozzle. After that period of time, according to the nature of the control, it switches over to a conductive mode, and thereafter the sensor functions to sense the existence of the flame. In this manner, the instrumentality just referred is utilized in controlling the amount of heat produced and applied.

An important feature of the invention is the control of the heat produced by the refractory burner, and its direct effect on the kettle. It may be desired to have only a small amount of heat, in a narrow annular area on the burner, which is mostly directed onto the lower lowermost area of the kettle, and the fuel may be burned on a progressively radially greater area for correspondingly directing the heat onto greater areas on the kettle.

The refractory burner inherently produces great heat, but it can be controlled within a wide range so that notwithstanding the great capacity of heat, a smaller amount may be produced according to the desired lesser amount of heat to be applied to the kettle. The combustion surface 78 of the refractory burner becomes incandescent and produces an immense amount of infra red heat which is impinged on the kettle in relatively great areas, and in greater effect than heat of other kinds. Notwithstanding this greater capacity, and great capacity, and great production of heat, the burner also can be controlled for producing as little heat as desired, within a wide range. The progressive or gradual control of the valve 90 enables this great control of heat.

Figure 9:
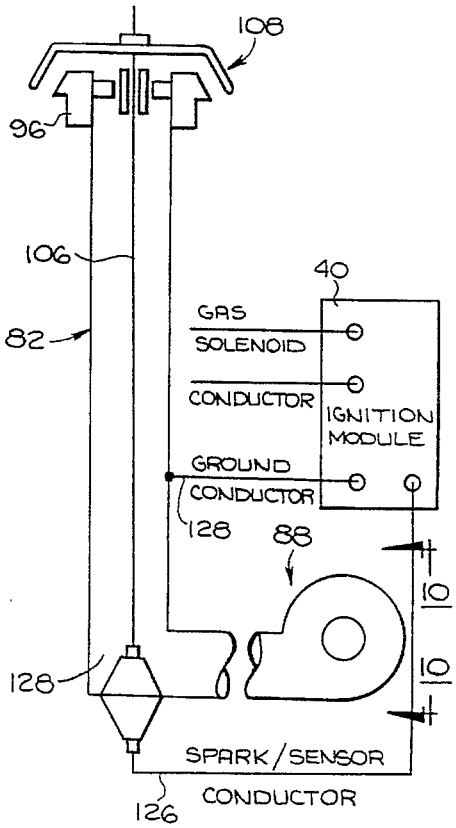
FIG. 9 is a detail view taken at line 9—9 of FIG. 8.

It is desired that the fuel be premixed, before entering the burner element, the blower producing a stream of air and fuel being drawn in or introduced into the pipe 82 (FIG. 9) by the stream of air, at a point such as indicated at 128 (FIGS. 5, 9). Such a premixed combustion component is fully illustrated in the co-pending application identified above, as previously indicated hereinabove.

In the making of candy in a commercial operation, relatively great quantities of heat are required at times. A large batch of candy is placed in the kettle, and after the cooking step the kettle is lifted out and carried to another location where a processing step on the candy is performed. Then another kettle with a batch therein is placed in the cooker for a repeated heating step. In such a commercial operation, where large quantities of candy are produced, a great amount of heat is applied to the kettle, and it is desired to cook the candy quickly for efficiency purposes, but in so applying a large amount of heat, there is danger of burning the candy, and the heat must immediately be reduced and controlled. This apparatus therefore enables such great quantities to be produced and controlled.

The heated air can be transmitted to other areas, as through ducts 68, after performing the function of heating the candy batch, and used for other heating purposes.

Thus the character of the apparatus is such that other components and units can be added on to an original basic unit, for utilizing great quantities of heat.

I claim:

1. A gas power plant comprising, a casing having a central vertical axis, a stand for supporting the casing, the casing having an upper compartment with a top circular kettle opening therein, and having a lower compartment, with a transverse partition between the compartments, the stand having upright kettle supports on opposite sides of the casing for supporting a kettle in active position at the top of the casing in which the kettle extends down into the upper compartment, a burner in the upper compartment at the bottom thereof and including a refractory member with a firing surface directed upwardly to a kettle in said active position, and the gas power plant also including a unit for transmitting fuel to the burner.

2. A gas power plant according to claim 1 wherein, said firing surface is of annular shape concentric with said central axis.

3. A gas power plant according to claim 2 wherein, the gas power plant is operable for use with said kettle of predetermined size with a substantially hemispherical bottom surface, wherein, the burner is operable for producing infrared rays on its firing surface, and the firing surface is so positioned and dimensioned as to be operable for directing infrared rays substantially throughout the area of said hemispherical bottom surface of the kettle.

4. A gas power plant according to claim 3 wherein, the burner member has a central vertical opening, and the gas power plant includes means for adjusting the burner for producing infrared rays in lesser areas adjacent the axis and increasingly outwardly in radial direction whereby to direct the infrared rays onto corresponding areas of the kettle.

5. A gas power plant according to claim 4 wherein, the burner includes a central fuel mixture inlet pipe having an outlet opening at the upper surface of the burner, and a flame deflector cap forming a circumferential gap and operable for deflecting fuel mixture form the inlet pipe onto the firing surface in an area continuously around the firing surface.

6. A gas power plant according to claim 5 wherein, the deflector cap is adjustably movably axially of the inlet pipe for thereby adjustably varying the axial dimension of the gap.

7. A gas power plant according to claim 6 wherein, the inlet pipe includes a flame distributor at its outlet end, the burner includes a rod mounting the deflector cap, the flame distributor and the deflector cap define said gap therebetween, and the fuel transmitting means is operable for moving the fuel mixture at such rate as to prevent reverse propagation of flame into the gap, a sensor is secured to said rod and extends into the area of flame on the firing surface, an electrical insulator is operably interposed between the sensor and flame distributor, control means for controlling transmission of fuel mixture through the fuel inlet pipe in response to the existence of flame on the firing surface, and circuit means operably incorporating the flame distributor and rod.

8. A gas power plant according the claim 7 wherein, the sensor and rod constitute an electrode and the flame distributor constitutes an electrode, and said electrodes are positioned to utilize the flame on the firing surface therebetween as an element in the electrical circuit.

9. A gas power plant according to claim 4 wherein, the adjusting means is operable for producing continuous adjustment in the burner.

10. A gas power plant according to claim 1 wherein, the casing has a metal element defining the top opening, the gas power plant is operable for use with a round metal kettle of predetermined size and having side handles extending radially outwardly therefrom, the side handles of the kettle being adapted to rest on said upright supports for supporting the kettle in its said active position, and the casing elements being so dimensioned, proportioned and arranged that when the kettle is in said active position, the space between the edge of the top opening and the kettle is near zero whereby to effectively seal that space notwithstanding the formation of that space by metal-to-metal abuttals and the absence of resilient gasket in the space.

11. A gas power plant according to claim 1 wherein, the gas power plant is operable for use with a said kettle having opposite side handles each having elements spaced apart circumferentially of the kettle, the kettle supports are adapted for receiving said handles and thereby supporting the kettle, and each kettle handle also having horizontal bars having extension circumferentially of the casing, whereby each kettle handle is supported at points spaced circumferentially whereby to stabilize the kettle.

12. A gas power plant according to claim 11 wherein, the points of engagement between the kettle handles and the horizontal bars of the kettle supports are spaced apart, substantial distances circumferentially whereby to enable utilization of shims between respective elements to facilitate stabilizing the kettle.

13. A gas power plant according to claim 1 wherein, the burner includes a refractory member having an upper firing surface, and the refractory member rests on and is supported by the partition.

* * * * *